US007350545B2

(12) United States Patent
Ruble et al.

(10) Patent No.: US 7,350,545 B2
(45) Date of Patent: Apr. 1, 2008

(54) FILLING VALVE APPARATUS

(75) Inventors: Edwin K. Ruble, Parkton, MD (US); Demetrios Stavrakis, Booklandville, MD (US); Ted McKaughan, Forest Hill, MD (US)

(73) Assignee: ADCOR Industries, Inc., Baltimore, MD (US)

( * ) Notice: Subject to any disclaimer, the term of this patent is extended or adjusted under 35 U.S.C. 154(b) by 0 days.

(21) Appl. No.: 11/685,858

(22) Filed: Mar. 14, 2007

(65) Prior Publication Data

US 2007/0169835 A1 Jul. 26, 2007

Related U.S. Application Data

(62) Division of application No. 11/079,157, filed on Mar. 14, 2005, now abandoned.

(60) Provisional application No. 60/552,788, filed on Mar. 12, 2004, provisional application No. 60/552,772, filed on Mar. 12, 2004.

(51) Int. Cl.
*B65B 43/42* (2006.01)

(52) U.S. Cl. ..... 141/147; 141/57; 141/144; 141/146; 141/285; 141/302

(58) Field of Classification Search ..... 141/6, 141/39, 57, 144–147, 192, 198, 285, 301, 141/302

See application file for complete search history.

(56) References Cited

U.S. PATENT DOCUMENTS 2,796,892 A 6/1957 Meyer
3,090,408 A * 5/1963 Naecker ..... 141/57
3,209,794 A * 10/1965 Granier ..... 141/46
4,014,372 A 3/1977 Dichiara
4,206,789 A 6/1980 Jordan et al.
4,398,575 A 8/1983 Brandon
4,431,037 A 2/1984 Schevey et al.
4,442,873 A 4/1984 Yun
4,445,549 A 5/1984 Bernhard
4,750,533 A 6/1988 Yun
4,979,546 A 12/1990 LaWarre, Sr. et al.
5,085,255 A 2/1992 LaWarre, Sr. et al.
5,139,058 A 8/1992 Yun
5,273,084 A 12/1993 Monnig
5,425,402 A 6/1995 Pringle
5,634,500 A 6/1997 Clusserath et al.
5,884,677 A 3/1999 McKaughan
5,992,455 A 11/1999 Koller et al.
6,131,624 A 10/2000 Paradies (Continued)

*Primary Examiner*—Timothy L. Maust
(74) *Attorney, Agent, or Firm*—Howard & Howard Attorneys, P.C.

(57) ABSTRACT

A filling valve apparatus having a body portion with an inner wall terminating at an aperture to define a sealing seat. The inner wall extends below the seat to define a trap for a fluid. A cage extends from the body portion with the cage having an inner wall mating with the inner wall of the body portion to define a continuous inner surface. A stem, having a seal, includes an outer surface that is complementary in configuration to the continuous inner surface to define a smooth passageway for the fluid as the fluid is directed into the container thereby ensuring a laminar flow of the fluid between the inner and outer surfaces and into the container. The filling valve apparatus also includes a pre-assembled body portion, valve assembly, cap assembly, lower vent tube assembly, and snift valve.

10 Claims, 6 Drawing Sheets

U.S. PATENT DOCUMENTS

| | | | |
|---|---|---|---|
| 6,135,166 | A | 10/2000 | Paradies et al. |
| 6,135,167 | A | 10/2000 | Kiholm |
| 6,179,016 | B1 | 1/2001 | Neacker et al. |
| 6,399,901 | B1 | 6/2002 | Nishino et al. |
| 6,463,964 | B2 | 10/2002 | Clusserath |
| 6,470,922 | B2 | 10/2002 | Sindermann |
| 2002/0003005 | A1 | 1/2002 | Martin |

* cited by examiner

FILLING VALVE APPARATUS

CROSS-REFERENCE TO RELATED APPLICATIONS

The subject patent application is a divisional of U.S. patent application Ser. No. 11/079,157, filed on Mar. 14, 2005, which is now abandoned.

The subject patent application claims priority to and all the benefits of U.S. Provisional Patent Applications Ser. Nos. 60/552,788 and 60/552,772, both of which were filed on Mar. 12, 2004.

BACKGROUND OF THE INVENTION

1. Field of the Invention

The subject invention relates to filling valve apparatuses for filling a container with a fluid, such as filling a bottle with a beverage.

2. Description of Related Art

Beverage filling machines typically include a large number of filling valve apparatuses, such as 40, 60, 72, 100, 120, or 130 filling valve apparatuses on any one beverage filling machine. Each of the filling valve apparatuses operate in sequence to fill a series of containers with a desired beverage, for example. There are numerous configurations of filling valve apparatuses and a variety of different methods for performing the filling operation. However, one common feature relates to the gases being vented from the container during the filling of the container with the fluid. The venting is typically accomplished through the use of a movable or stationary vent tube.

Examples of movable vent tubes are disclosed in U.S. Pat. Nos. 4,979,546 and 5,884,677, which may move between a closed position blocking the flow of fluid into the container and an open position allowing the flow of fluid into the container. As the fluid flows into the container the gases within the container are vented up through the vent tube until the container reaches a predetermined fill level. At this point, the vent tube is blocked to prevent any further ventilation of the gases, which in turn will automatically stop the flow of fluid. The fluid, however, can have a tendency to leak or drip into the container. As known to those skilled in the art, this leaking or dripping creates a host of problems.

One solution to reduce or even eliminate the leaking or dripping is to install a screen within the flow opening of the filling valve apparatus. Both the '546 and '677 patents disclose filling valve apparatuses having screens movably mounted to the vent tube. Surface tension is created between the screen and the fluid material, which operates to hold the fluid material within the holes of the screen. Screens however can have drawbacks. The screens are an added expense, can be difficult to install, will clog over time, and are subject to servicing.

Another solution to reduce or eliminate the leaking or dripping is to form a fluid trap in the filling valve apparatus. U.S. Pat. No. 4,442,873 discloses a filling valve apparatus with a fluid trap, which eliminates the need for a screen. These types of designs, however, traditionally suffer from slow fill rates. Also, the flow of fluid can become agitated, which can cause foaming and a number of other problems.

Accordingly, it would be desirable to develop a filling valve apparatus that eliminates the use of a screen and maintains fast fill rates while retaining a laminar flow of the fluid passing into the container. Further, it would be advantageous to develop a filling valve apparatus that can be easily and quickly installed and serviced.

SUMMARY OF THE INVENTION AND ADVANTAGES

The subject invention includes a filling valve apparatus for filling a container with a fluid. The apparatus comprises a body portion defining an aperture for directing the fluid into the container with the body portion having an inner wall terminating at the aperture to define a sealing seat. The inner wall extends below the seat to define a trap for the fluid. A cage extends from the body portion with the cage having an inner wall mating with the inner wall of the body portion to define a continuous inner surface. A movable member has a seal movably disposed within the body portion between a closed position with the seal seated against the sealing seat for blocking a flow of the fluid into the container and an open position with the seal spaced from the sealing seat for allowing the fluid to flow into the container. The apparatus is characterized by the movable member having an outer surface that is complementary in configuration to the continuous inner surface to define a smooth passageway for the fluid as the fluid is directed into the container thereby ensuring a laminar flow of the fluid between the inner and outer surfaces and into the container.

The subject invention also includes a filling valve apparatus comprising a valve assembly selectively mounted to the body portion and extending outwardly therefrom. The valve assembly including the cage and a stem movably mounted to the cage with the stem defining an upper vent tube and having a seal seated against the body portion when the stem is in a closed position and spaced from the body portion when the stem is in an open position. A cap assembly is selectively mounted to the valve assembly. The cap assembly includes a cap and a spring with the cap having a seal engaging the stem when the stem is in the closed position. A lower vent tube assembly is selectively mounted to the upper vent tube of the stem with the lower vent tube assembly including a ball cage and a check ball disposed within the ball cage for selectively sealing the upper and lower vent tubes.

Accordingly, the subject invention eliminates the use of a screen through the use of a trap. The subject invention ensures quick fill rates and laminar flow by uniquely configuring the components to provide a smooth uninterrupted passageway. The subject invention also compartmentalizes the filling valve apparatus into distinct components, thereby increasing the efficiency for installation and servicing of the filling valves.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
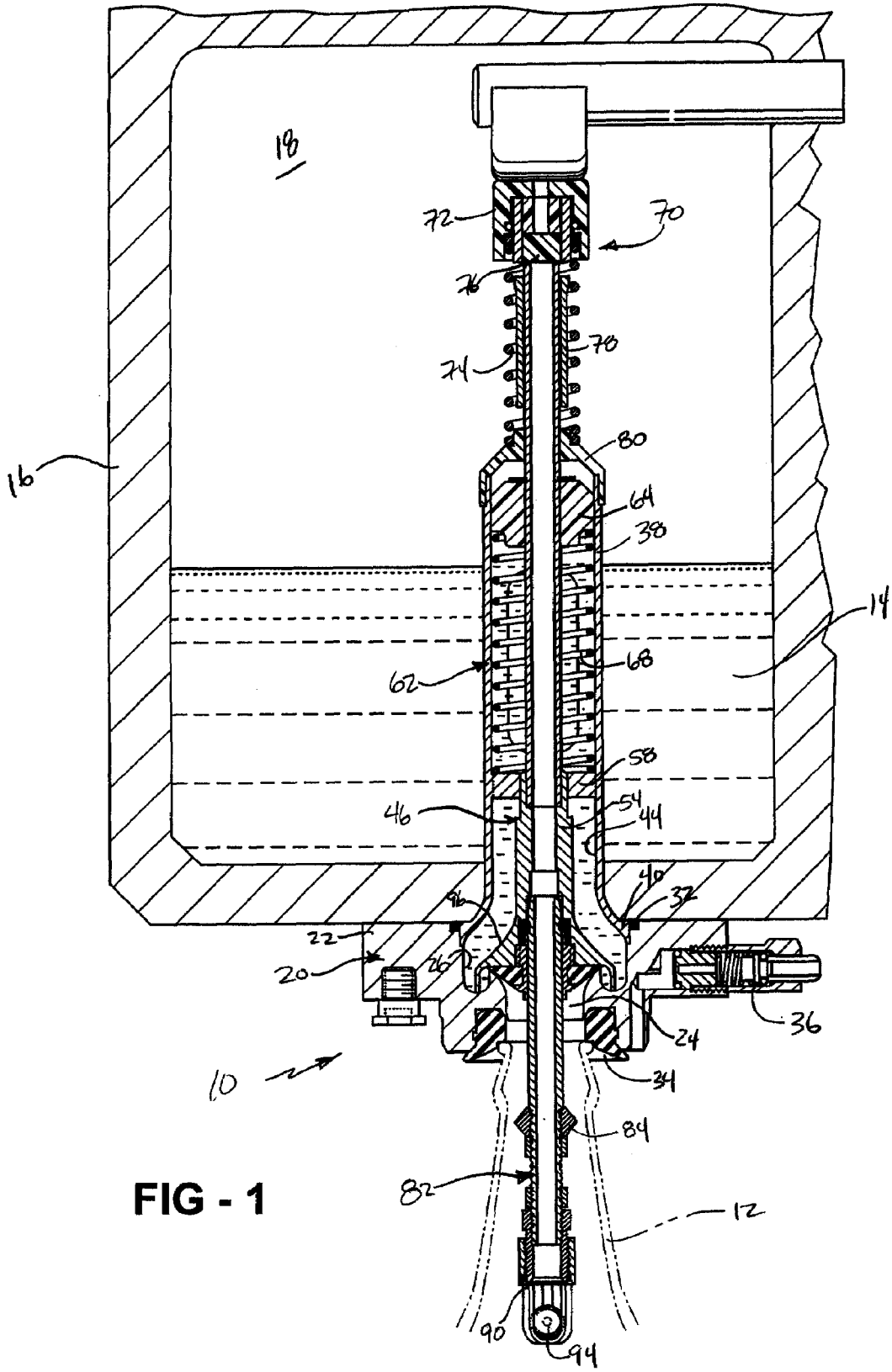
FIG. 1 is a partially cross-sectional view of a filling valve apparatus connected to a beverage filling machine in a closed position.

Referring to the Figures, wherein like numerals indicate like or corresponding parts throughout the several views, a filling valve apparatus for filling a container 12 with a fluid 14 is generally shown at 10 in FIGS. 1-5. The filling valve apparatus 10 is connected to a tank 16 of a beverage filling machine. As discussed in the background section above, there are typically 40, 60, 72, 100, 120, or 130 filling valve apparatuses on any one beverage filling machine. A typical tank 16 or ring bowl has an annular configuration and contains the liquid or beverage material for filling the containers. A space is disposed above the liquid for providing a headspace 18 for a pressurized inert gas such as carbon dioxide or nitrogen. The tank 16 and other associated components of the beverage filling machine do not form part of the claimed invention and will therefore not be discussed in any detail. It should be appreciated that the tank 16 and beverage filling machine may be of any suitable design or configuration. The example illustrated discloses the filling valve apparatus 10 for use with filling bottles with a beverage. It should be appreciated that the filling valve apparatus 10 could fill any type of container, such as a can, jar, or bottle, with any type of fluid material, such as carbonated beverages, juices, water, or the like. Each of the filling valve apparatuses 10 are substantially identical such that only one filling valve apparatus 10 will be discussed in any greater detail below.

Figure 6:
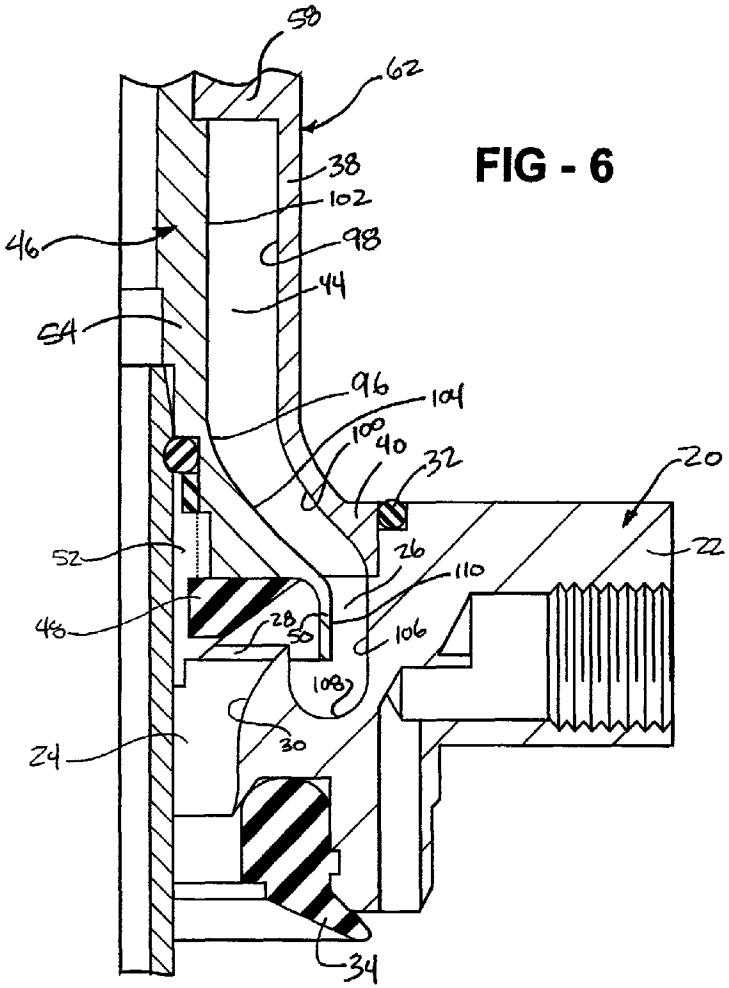
FIG. 6 is an enlarged fragmentary cross-sectional view of an uninterrupted smooth passageway of the filling valve apparatus.
Figure 1:
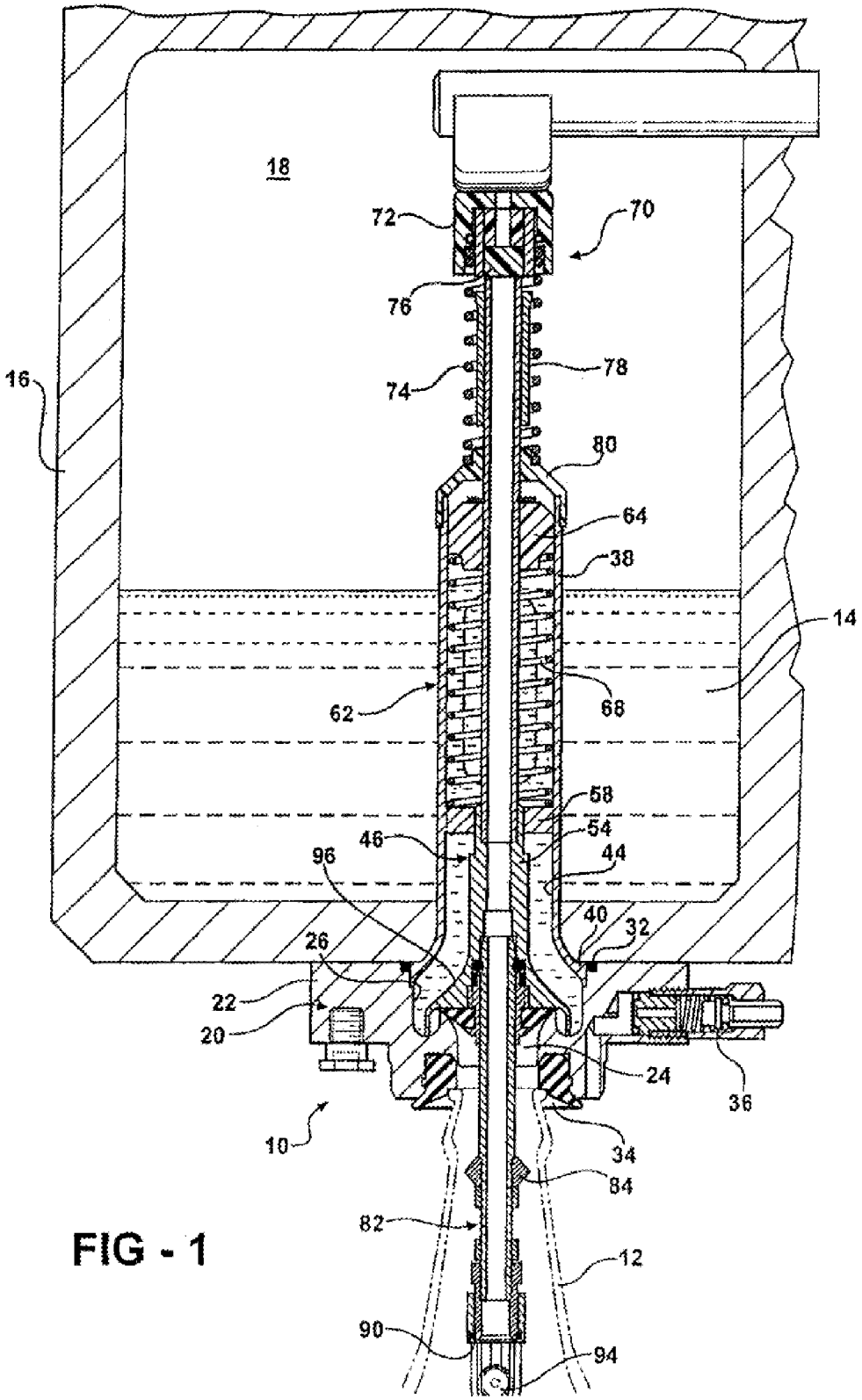
Figure 2:
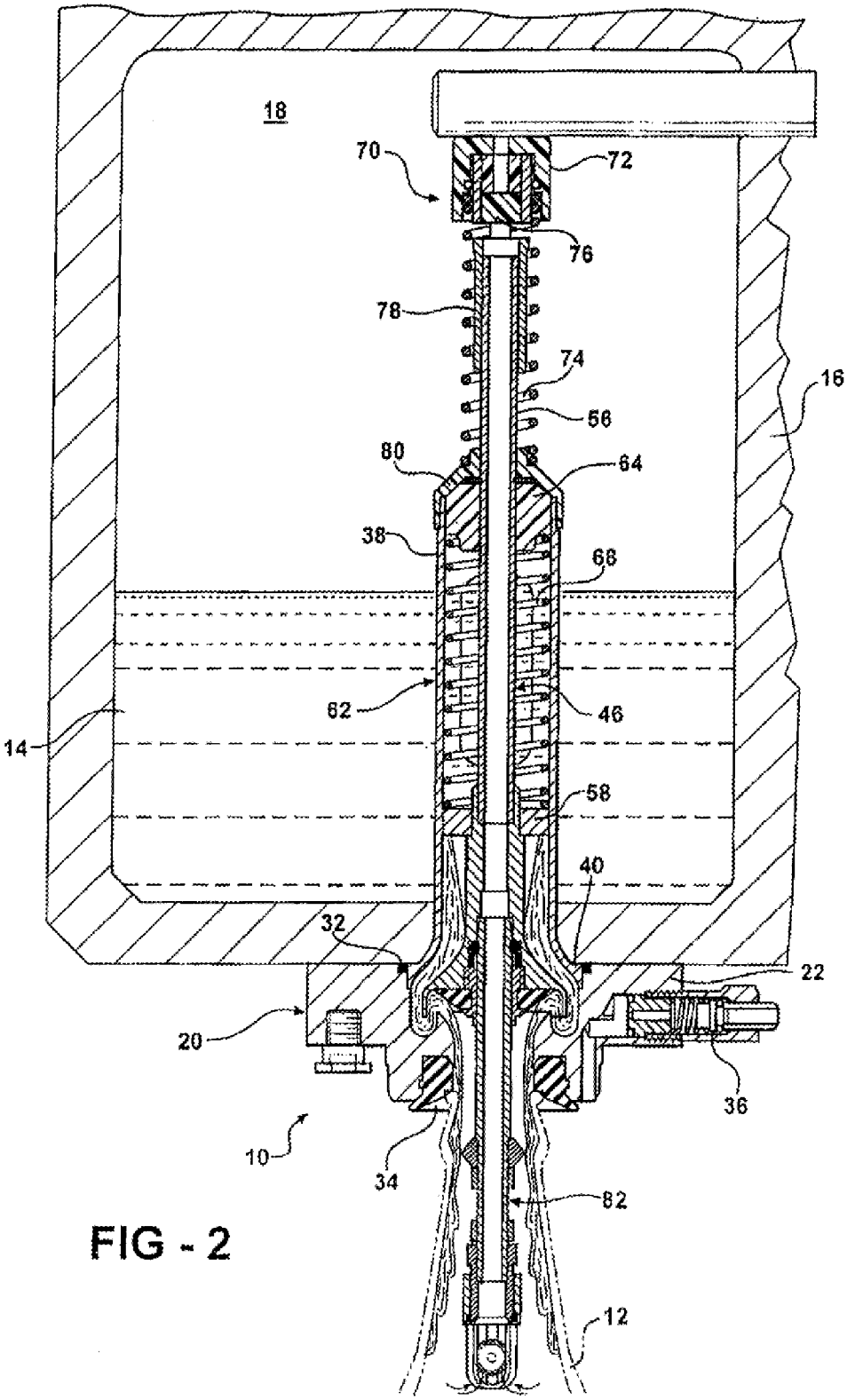
Figure 3:
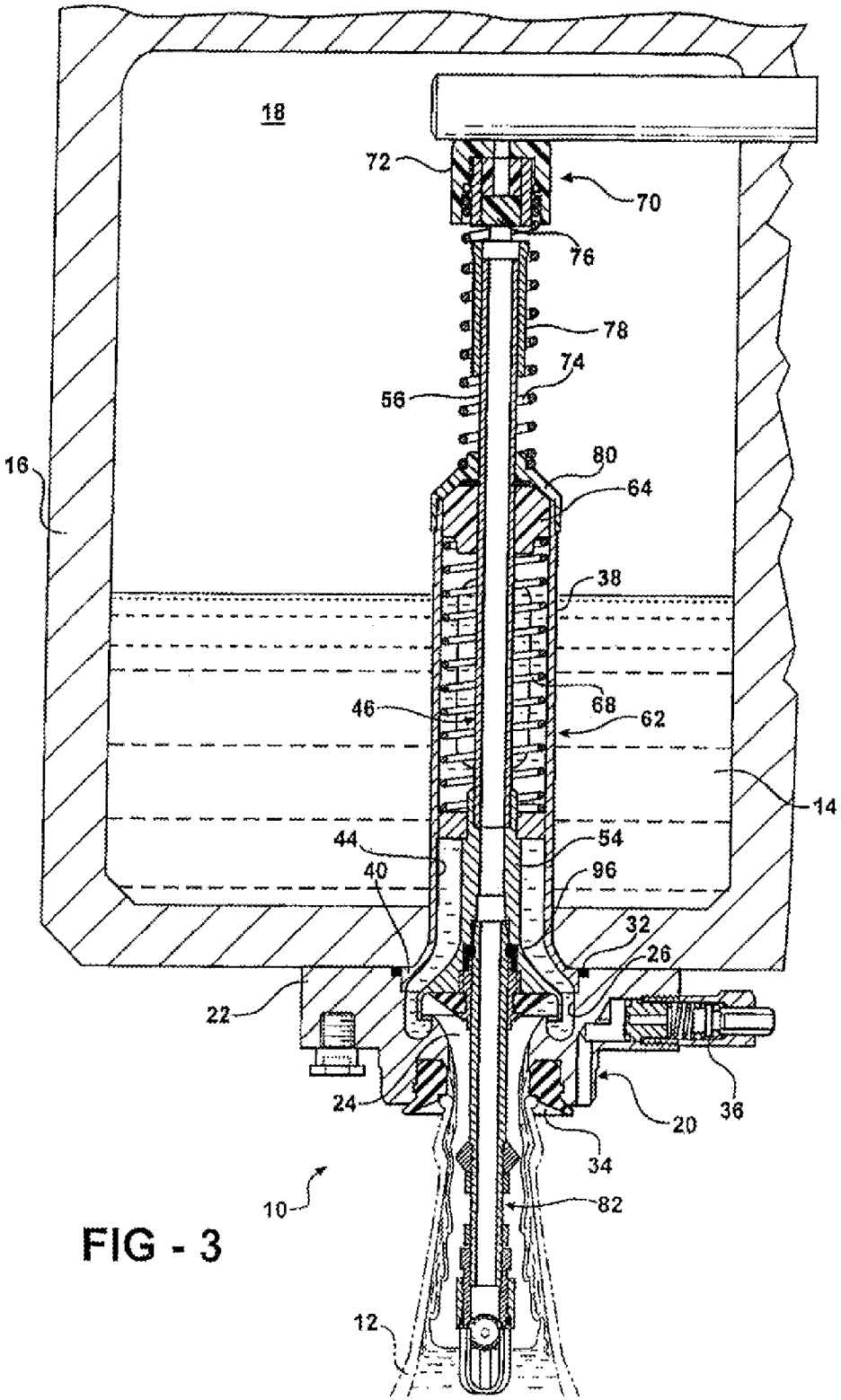
Figure 4:
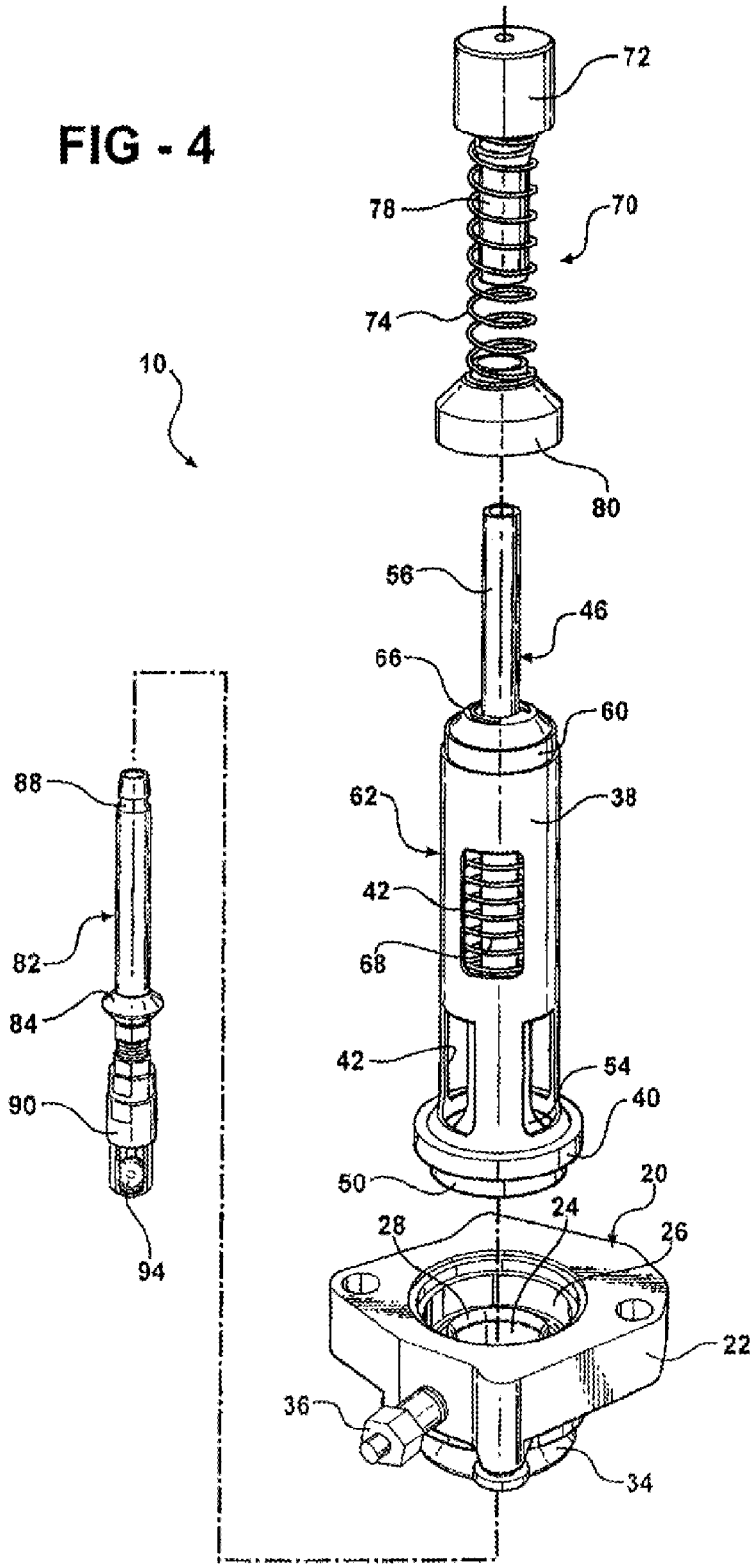
Figure 5:
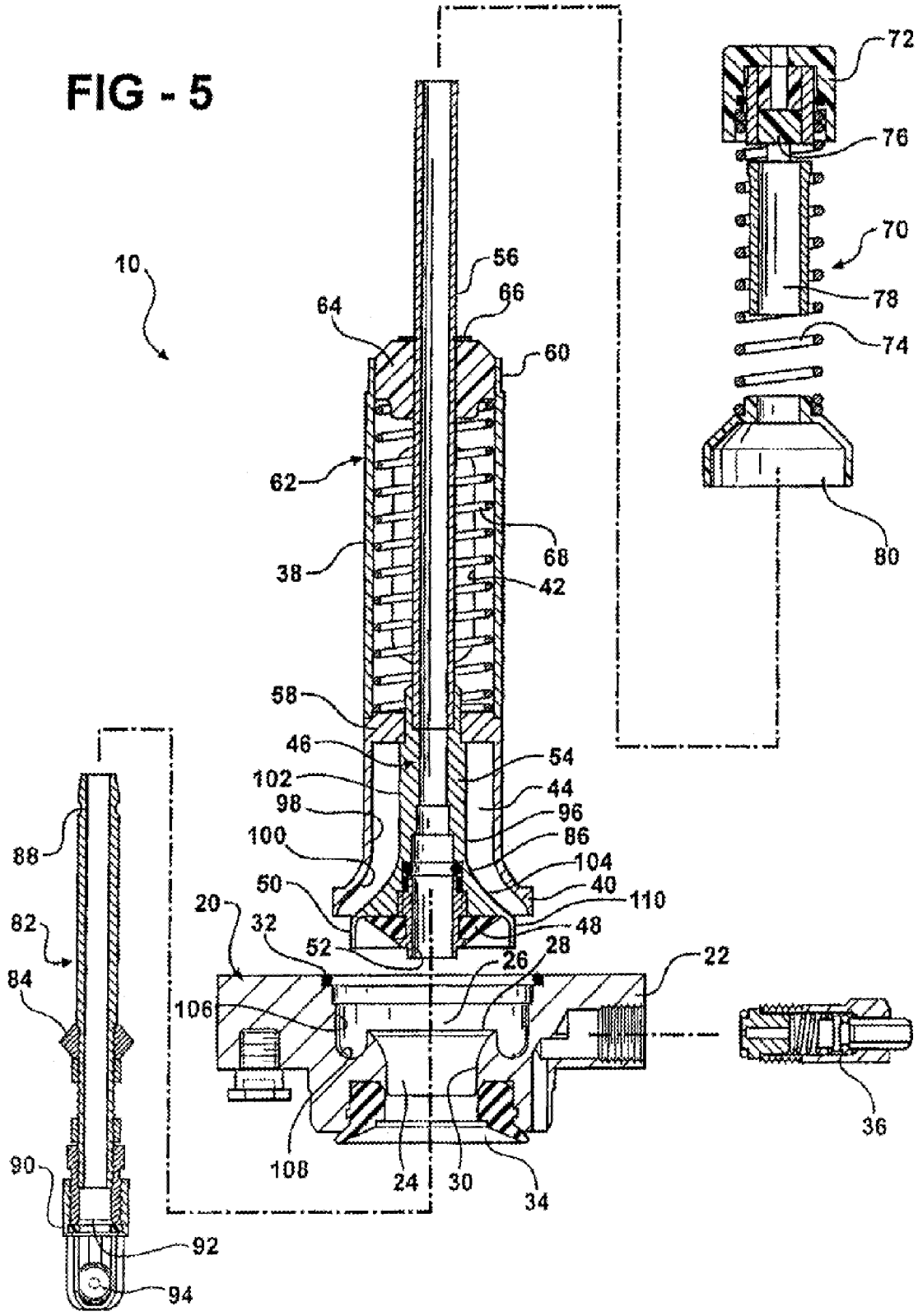
Figure 7:
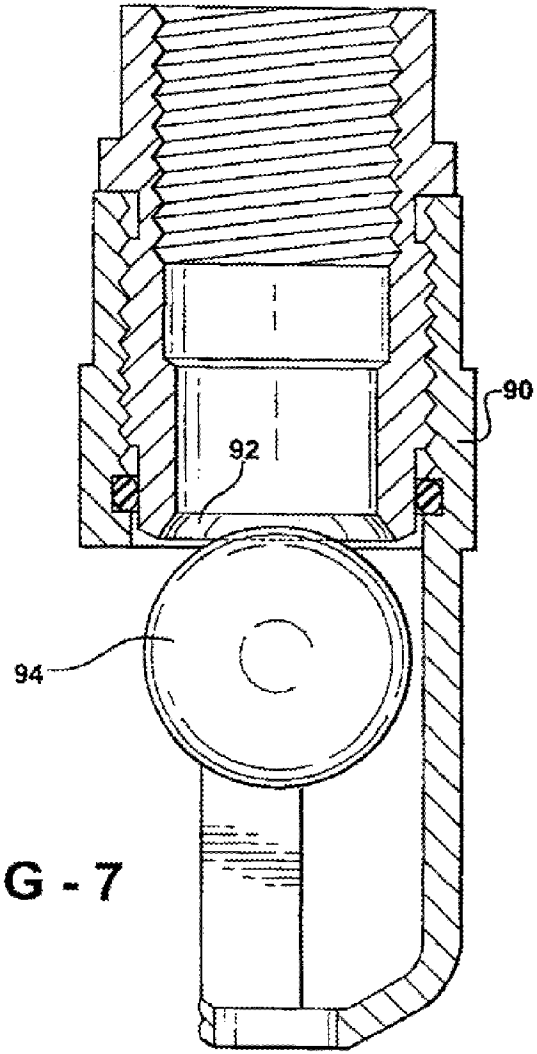
Figure 6:
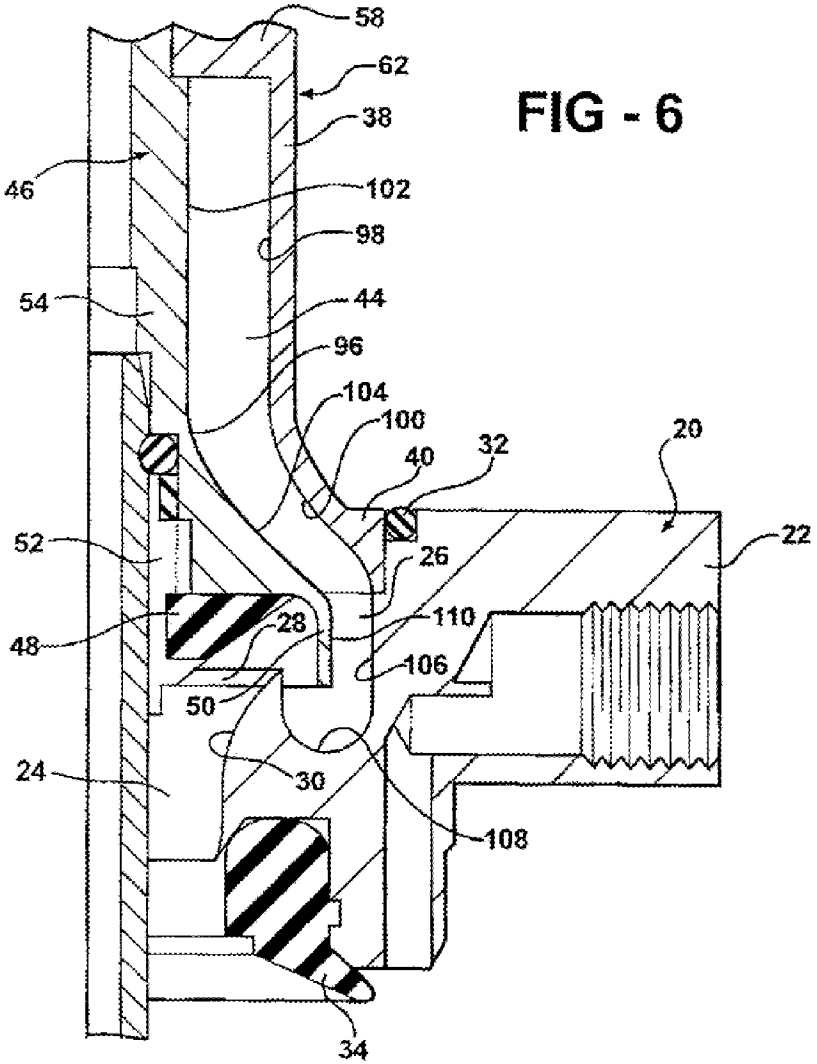

The filling valve apparatus 10 includes a body portion 20 having a mounting flange 22, which abuts the beverage filling machine. The body portion 20 also defines an aperture 24 for directing the fluid 14 into the container 12. The body portion 20 has an inner wall 26 terminating at the aperture 24 to define a sealing seat 28. The inner wall 26 also extends below the seat 28 to define a trap for the fluid 14. As best shown in FIG. 6, an aperture wall 30 extends from the sealing seat 28 downward toward the container 12. Specifically, the aperture wall 30 curves inwardly toward the aperture 24 from the sealing seat 28 and straightens to extend vertically toward the container 12. The aperture wall 30 then curves inwardly again toward the aperture 24 at an opposing end from the sealing seat 28. A seal 32 is mounted to a top of the body portion 20 for sealing engagement with the tank 16. Also a container seal 34 is mounted to a bottom of the body portion 20 about the aperture 24. Additional devices, such as a snift valve 36 or a purge valve (not shown), may be mounted to the body portion 20 to assist in the operation of the filling machine as is known in the art.

A cage 38 extends from the body portion 20 and into the tank 16. Preferably, the cage 38 is a separate component mounted within a machined groove in the body portion 20. The cage 38 includes a lip 40 that is trapped between the body portion 20 and the tank 16 when the filling valve apparatus 10 is installed on the tank 16 which in turn secures the cage 38 to the body portion 20 and the tank 16. It should be appreciated that the cage 38 could be an integral part of the body portion 20. The cage 38 extends through the fluid 14 in the tank 16 up to the headspace 18. The cage 38 includes a number of openings 42 for allowing the fluid 14 to flow into the cage 38 and down into the body portion 20. The cage 38 has an inner wall 44 mating with the inner wall 26 of the body portion 20 to define a continuous inner surface 26, 44.

A movable member 46, having a seal 48 mounted thereto, is movably disposed within the body portion 20. As is discussed in greater detail below, the movable member 46 moves between a closed position with the seal 32 seated against the sealing seat 28 for blocking a flow of the fluid 14 into the container 12 and an open position with the seal 32 spaced from the sealing seat 28 for allowing the fluid 14 to flow into the container 12. The seal 32 also engages a portion of the curved aperture wall 30 when in the closed position. The movable member 46 includes a flange 50 with the flange 50 having a distal end. As discussed in greater detail below, the distal end remains within the trap during the movement of the movable member 46 between the closed and open positions for preventing gases from leaking around the trap during an operation of the apparatus. Preferably, the seal 48 is mounted to the movable member 46 within the flange 50 by an insert 52.

The illustrated embodiment discloses the filling valve apparatus 10 configured to fill bottles 12 with a liquid beverage 14. In this illustrated embodiment, the movable member 46 is further defined as a stem 46 movably mounted within the cage 38. The stem 46 includes a bell-shaped portion 54 and an upper vent tube 56 extending from the bell-shaped portion 54. The bell-shaped portion 54 and the upper vent tube 56 have aligned bores for ventilating gases during an operation of the apparatus. The flange 50 is preferably an integral part of the bell-shaped portion 54.

The cage 38 includes an intermediate support 58 and the bell-shaped portion 54 includes a narrower section that slides within the intermediate support 58. The bell-shaped portion 54 also includes a notch that selectively engages the intermediate support 58 to provide a stop for the stem 46 when the stem 46 is in the open position. The cage 38 also includes an exterior recess 60 formed at a top thereof (see FIGS. 4 and 5).

The cage 38, stem 46, seal 48, and upper vent tube 56 define a unitary valve or cartridge assembly 62 selectively mounted to the body portion 20. The valve assembly 62 also includes a guide block 64 secured to the upper vent tube 56. Preferably, the seal 48 and guide block 64 of the valve assembly 62 are formed of a polymeric material. The guide block 64 includes an opening such that the upper vent tube 56 can extend therethrough. A fastener 66, such as a clip, secures the guide block 64 to the upper vent tube 56 such that the guide block 64 and stem 46 move as a single unit. A spring 68 is disposed within the cage 38 to continuously bias the stem 46 toward the open position. The spring 68 engages the guide block 64 at one end and the intermediate support 58 at the other end. Hence, the spring 68 reacts against the cage 38 on one end and the stem 46 on the other end. The cage 38, stem 46, seal 48, upper vent tube 56, and guide block 64 are all interconnected to define a pre-assembled unitary valve assembly 62.

The filling valve apparatus 10 also includes a cap or charging assembly 70 selectively mounted to the valve assembly 62. The cap assembly 70 includes a cap 72 and a spring 74 secured to the cap 72. The cap 72 has a seal 76 engaging the stem 46 when the stem 46 is in the closed position (see FIG. 1). The cap assembly 70 further includes a sleeve 78 mounted within the cap 72. In addition, the cap assembly 70 includes a cover 80 mounted to an opposing end of the spring 74. The cover 80 is disposed on the recess 60 of the cage 38 and substantially surrounds the block 64. Preferably, the cap 72, seal 76, and cover 80 are formed of a polymeric material. The cap 72, seal 76, spring 74, sleeve 78, and cover 80 are all interconnected to define a pre-assembled unitary cap assembly 70.

The filling valve apparatus 10 further includes a lower vent tube assembly 82 mounted to the stem 46. In the illustrated embodiment, the lower vent tube assembly 82 is mounted to the bell-shaped portion 54 of the stem 46. The lower vent tube assembly 82 includes a bore aligned with the bores of the bell-shaped portion 54 and the upper vent tube 56 for ventilating the gases within the container 12 during an operation of the filling valve apparatus 10. The lower vent tube assembly 82 also includes a deflector 84 for redirecting any fluid 14 toward the walls of the container 12. Preferably, the stem 46 includes a locking device 86 and the lower vent tube assembly 82 includes an integral groove 88 engaging the locking device 86 when the lower vent tube assembly 82 is mounted to the stem 46. Even more preferably, the locking device 86 is at least one seal 86 disposed within the bell-shaped portion 54 of the stem 46. In the embodiment illustrated, the locking device 86 includes a pair of seals 86 that are secured to the stem 46 by the insert 52.

Figure 7:
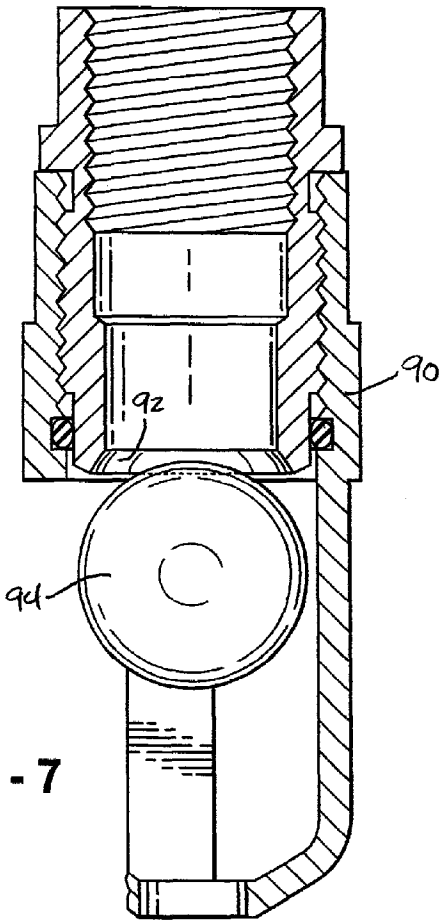
FIG. 7 is an enlarged cross-sectional view of a ball cage with a check ball.

As also shown in FIG. 7, the lower vent tube assembly 82 includes a ball cage 90 having a ball seat 92. A check ball 94 is disposed within the ball cage 90 for selectively engaging the ball seat 92 to seal the bores. The ball cage 90 is geometrically configured to prevent undesirable engagement of the check ball 94 with the ball seat 92. In particular, the ball cage 90 includes three elongated arms that are lengthened to allow the check ball 94 to move upward within the ball cage 90 during certain conditions without engaging the ball seat 92.

The check ball 94 is spherical and defines a radius of curvature. The ball seat 92 of the ball cage 90 includes a radius of curvature that is complementary in configuration with the radius of curvature of the check ball 94 for preventing gases from leaking into the bores during an operation of the apparatus. In particular, the radii of curvature ensure a proper and adequate seal between the check ball 94 and the ball cage 90, thereby reducing or eliminating the seepage of gases into the bores and the resultant leakage of fluid 14 into the container 12. This is an improvement over prior art ball cage/check ball assemblies that can, at times, allow seepage of gases.

Figure 4:
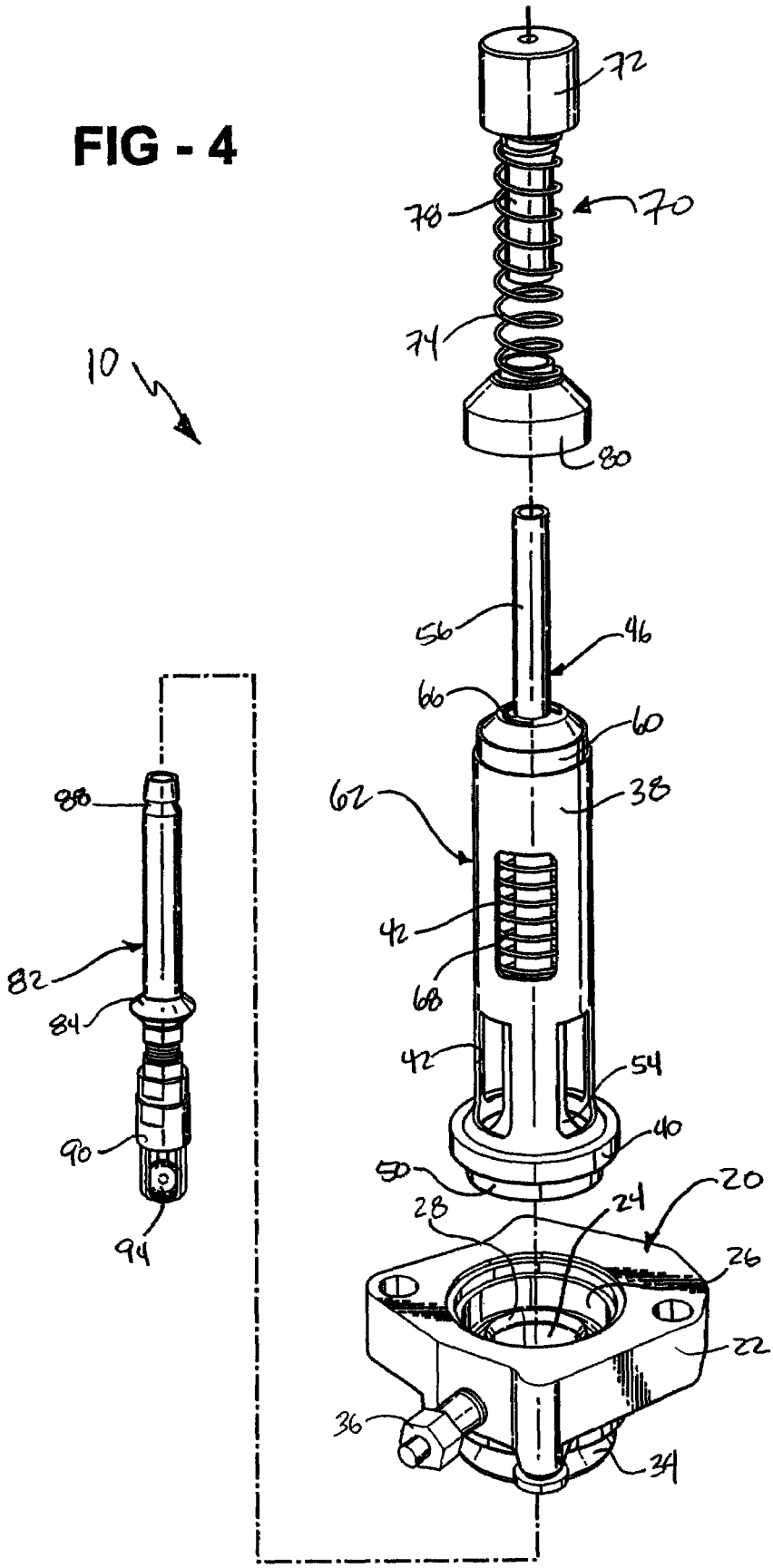
FIG. 4 is an exploded perspective view of the filling valve apparatus.
Figure 5:
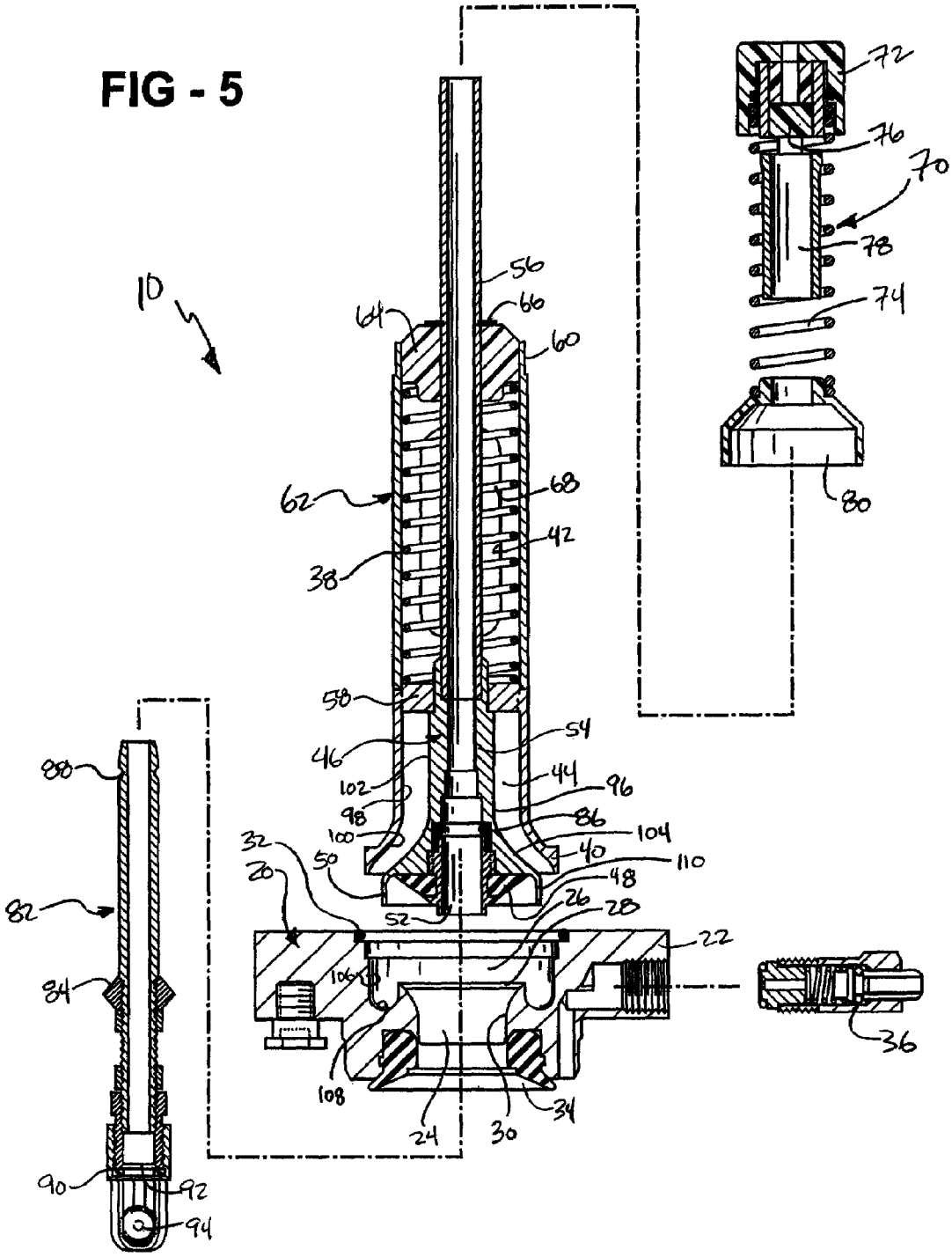
FIG. 5 is an exploded partially cross-sectional view of the filling valve apparatus.

As shown in FIGS. 4 and 5, the body portion 20, valve assembly 62, cap assembly 70, lower vent tube assembly 82, and snift valve 36 are all pre-assembled separate and distinct components of the filling valve apparatus 10. These separate pre-assembled components house the working parts of the apparatus 10 into easily assembled and serviced pieces. The pre-assembled components utilize an adhesive composition that is strategically disposed within the pre-assembled components to permanently bond, or lock, certain pieces together. This adhesive also functions to seal all of the various parts of the pre-assembled components. Each of the pre-assembled components can be marketed and sold as disposable single units. During assembly or servicing of the filling valve apparatus 10, each of these components can be quickly and efficiently installed or replaced. This procedure greatly increases the efficiency of the service process and ensures that all of the working parts are replaced, which in turn equates to reliable and consistent maintenance of the filling valve apparatus 10. This compartmentalizing feature is an improvement over prior art filling valve apparatuses.

Turning to FIGS. 1-4 and in particular FIGS. 5 and 6, another unique feature of the filling valve apparatus 10 is discussed in greater detail. In particular, the movable member 46 has an outer surface 96 that is complementary in configuration to the continuous inner surface 26, 44 to define a smooth passageway for the fluid 14 as the fluid 14 is directed into the container 12 thereby ensuring a laminar flow of the fluid 14 between the inner 26, 44 and outer 96 surfaces and into the container 12. The continuous inner surface 26, 44 includes a first substantially vertical section 98 and an outwardly curved section 100 extending from the first vertical section 98 of the inner surface 26, 44. Similarly, the outer surface 96 includes a first substantially vertical section 102 and an outwardly curved section 104 extending from the first vertical section 102 of the outer surface 96. The sections 102, 104 of the outer surface 96 are complementary in configuration with the sections 98, 100 of the inner surface 26, 44 to further define the smooth passageway having an uninterrupted substantially vertical portion and an uninterrupted outwardly curved portion for directing the flow of fluid 14 outboard of the vertical sections 98, 102.

The continuous inner surface 26, 44 further includes a second substantially vertical section 106 extending from the curved section 100 of the inner surface 26, 44. The continuous inner surface 26, 44 further includes a pocket section 108 extending from the second vertical section 106 of the inner surface 26,44 to further define the trap for the fluid 14. Similarly, the outer surface 96 further includes a second substantially vertical section 110 extending from the curved section 104 of the outer surface 96. The second vertical section 110 of the outer surface 96 is aligned with the second vertical section 106 of the inner surface 26, 44 to further define the smooth passageway.

In the preferred embodiment, the inner wall 44 of the cage 38 defines the first vertical section 98 and the curved section 100 of the inner surface 26, 44. The inner wall 26 of the body portion 20 defines the second vertical section 106 of the inner surface 26, 44. The bell-shaped portion 54 of the movable member 46 defines the outer surface 96 having the first vertical section 102 and the curved section 104. The flange 50 of the bell-shaped portion 54 further defines the outer surface 96 and the smooth passageway. In particular, the flange 50 defines the second substantially vertical section 110 of the outer surface 96 which is aligned with the second vertical section 106 of the inner surface 26, 44 to further define the smooth passageway.

The sealing seat 28 is preferably aligned vertically with the first vertical section 98 of the inner surface 26, 44 such that the trap is entirely disposed outboard of the first vertical section 98 of the inner surface 26, 44. This geometrical orientation operates to ensure a smooth laminar flow of the fluid 14. The first vertical section 98 and the curved section 100 of the inner surface 26, 44 define a first radius. Similarly, the first vertical section 102 and the curved section 104 of the outer surface 96 define a second radius. In the preferred embodiment, the second radius is equal to the first radius such that this geometrical relationship further ensures a smooth laminar flow of the fluid 14.

Figure 2:
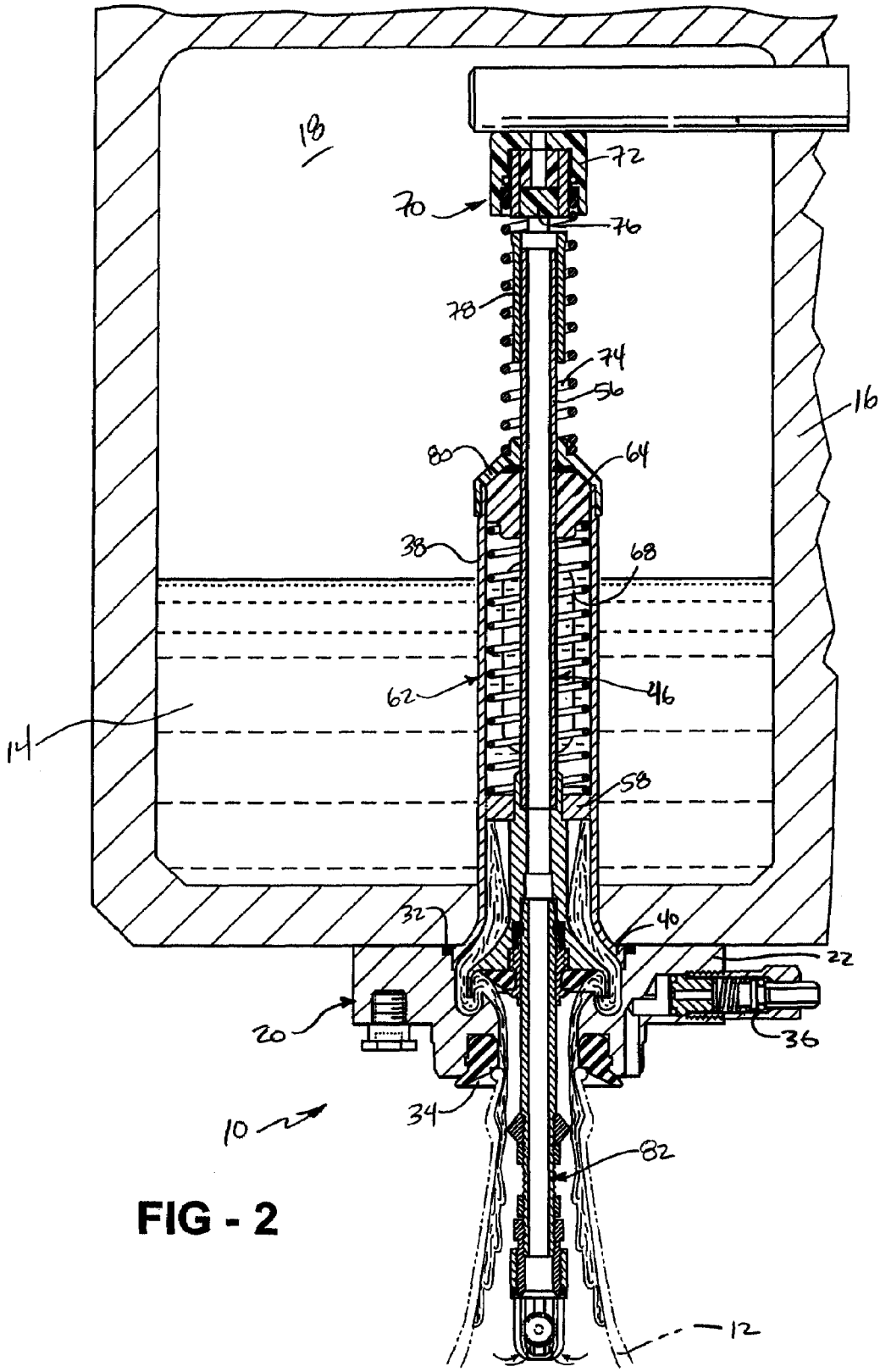
FIG. 2 is a partially cross-sectional view of the filling valve apparatus in an open position.
Figure 3:
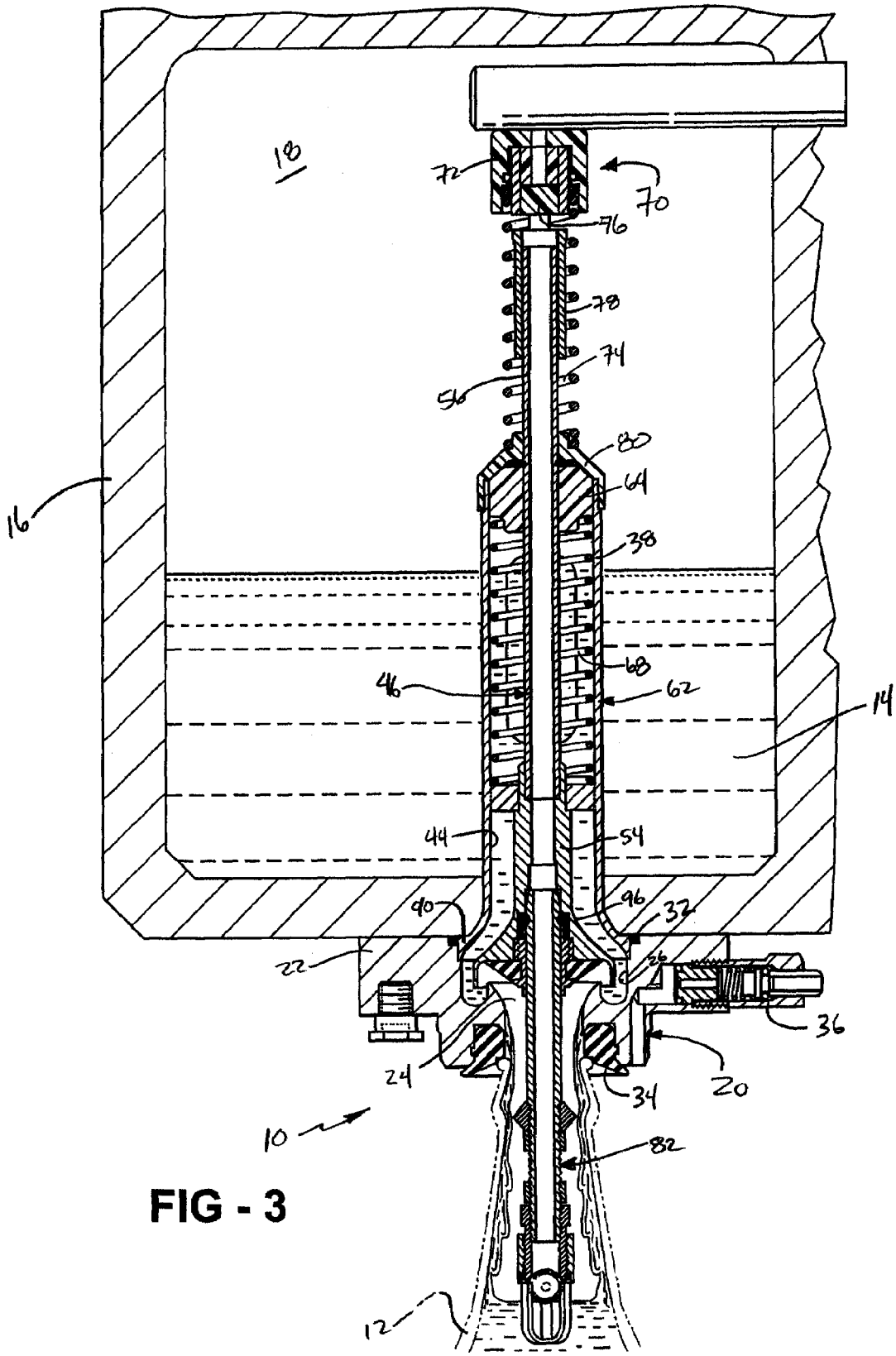
FIG. 3 is a partially cross-sectional view of the filling valve apparatus in an intermediate fill position.

Referring to FIGS. 1-3, a brief description of the operation of the subject filling valve apparatus 10 will be discussed. As will become apparent to those skilled in the art, there are a number of additional operations that are not addressed. These steps are well known and do not form any part of the novelty of the subject invention.

As shown in FIG. 1, the stem 46 is in the closed position with the seal 48 of the stem 46 engaging the sealing seat 28 of the body portion 20 to block the flow of liquid 14 into the aperture 24 and the bottle 12. FIG. 2 illustrates the stem 46 in the open position with the seal 48 spaced from the sealing seat 28. The liquid 14 flows through the smooth passageway between the inner surfaces 26, 44 of the cage 38 and body portion 20 and the outer surfaces 96 of the stem 46. As mentioned above, the inner 26, 44 and outer 96 surfaces are geometrically configured to provide an uninterrupted smooth path for the liquid 14. The liquid 14 then moves through the trap in the body portion 20 and reverses direction to temporarily flow upward. Once the liquid 14 passes over the sealing seat 28, gravity pulls the liquid 14 downward through the aperture 24, past the container seal 34 and into the bottle 12. The liquid 14 flows along the aperture walls 30, container seal 34, and bottle 12 in a smooth laminar manner because of the unique geometrical configurations of the inner 26,44 and outer 96 surfaces. Gases within the bottle 12 evacuate out of the bottle 12 and up through the lower vent tube assembly 82 as the bottle 12 is filled with the liquid 14. As appreciated by those skilled in the art, as a neck of the bottle 12 becomes narrower, the flow of the gases increases. This increased flow of gases can push the check ball 94 upward within the ball cage 90, see FIG. 2. In some prior art systems, the check ball 94 can even engage the ball seat 92, which reduces the effectiveness of the filling operation. As discussed above, the ball cage 90 is geometrically configured such that the check ball 94 can move upward within the ball cage 90 without engaging the ball seat 92.

Turning to FIG. 3, the bottle 12 is now close to a predetermined fill position. The check ball 94 engages the ball seat 92, which, as discussed above, have complementary radii, to block the bore in the lower vent tube assembly 82. The venting of gases through the lower vent tube assembly 82 and stem 46 are now stopped. The liquid 14 remaining in the aperture 24 falls down into the bottle 12. FIG. 3 specifically illustrates the moment in time where the check ball 94 has just engaged the ball seat 92 and the remaining amount of liquid 14 is falling into the bottle 12. The liquid 14 within the trap creates a liquid seal to prevent the evacuation of gases up and around the stem 46. In particular, the distal end of the flange 50 remains disposed within the liquid 14 caught in the trap to define a liquid barrier. Hence, any gases attempting to escape will encounter the flange 50 and then the liquid barrier.

The stem 46 is then moved downwardly to return to the position shown in FIG. 1 and the filled bottle 12 is removed. The filling process can now repeat.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention maybe practiced otherwise than as specifically described.

What is claimed is:

1. A filling valve apparatus for filling a container with a fluid, said apparatus comprising:

a body portion defining an aperture for directing the fluid into the container;

a valve assembly selectively mounted to said body portion with, said valve assembly including a cage and a stem movably mounted to said cage with said stem defining an upper vent tube and having a seal seated against said body portion when said stem is in a closed position and spaced from said body portion when said stem is in an open position;

a cap assembly selectively mounted to said valve assembly, said cap assembly including a cap and a spring secured to said cap with said cap having a seal engaging said stem when said stem is in said closed position; and a lower vent tube assembly selectively mounted to said stem with said lower vent tube assembly including a ball cage and a check ball disposed within said ball cage for selectively sealing said upper and lower vent tubes.

2. An apparatus as set forth in claim 1 wherein said valve assembly further includes a block secured to said upper vent tube with said block housed within said cage such that said stem is movably secured within said cage.

3. An apparatus as set forth in claim 2 wherein said stem includes a bell-shaped portion mounted to said upper vent tube and supporting said seal.

4. An apparatus as set forth in claim 3 further including a spring disposed within said cage and engaging said block to continuously bias said stem toward said open position.

5. An apparatus as set forth in claim 1 wherein cap assembly further includes a sleeve mounted to said cap.

6. An apparatus as set forth in claim 1 wherein said stem defines a bore and said lower vent tube assembly defines a bore aligned with said bore of said stem for ventilating gases during an operation of said apparatus.

7. An apparatus as set forth in claim 6 wherein said stem includes a locking device and said lower vent tube assembly includes an integral groove engaging said locking device when said lower vent tube assembly is mounted to said stem.

8. An apparatus as set forth in claim 6 wherein said ball cage of said lower vent tube assembly includes a ball seat with said check ball selectively engaging said ball seat to seal said bores.

9. An apparatus as set forth in claim 8 wherein said check ball includes a radius of curvature and said ball seat of said ball cage includes a radius of curvature that is complementary in configuration with said radius of curvature of said check ball for preventing gases from leaking into said bores during an operation of said apparatus.

10. An apparatus as set forth in claim 3 wherein said bell-shaped portion and said upper vent tube having aligned bores for ventilating gases during an operation of the apparatus.

* * * * *

UNITED STATES PATENT AND TRADEMARK OFFICE

CERTIFICATE OF CORRECTION

PATENT NO. : 7,350,545 B2
APPLICATION NO. : 11/685858
DATED : April 1, 2008
INVENTOR(S) : Edwin K. Ruble, Demetrios Stavrakis and Ted McKaughan It is certified that error appears in the above-identified patent and that said Letters Patent is hereby corrected as shown below:

The title page showing the illustrative figure should be deleted to be replaced with the attached title page.

The drawing sheets, consisting of Figs. 1-7, should be deleted to be replaced with the drawing sheets, consisting of Figs. 1-7, as shown on the attached page.

Signed and Sealed this

Twelfth Day of August, 2008

JON W. DUDAS
*Director of the United States Patent and Trademark Office*

(12) United States Patent
Ruble et al.

(10) Patent No.: US 7,350,545 B2
(45) Date of Patent: Apr. 1, 2008

(54) FILLING VALVE APPARATUS

(75) Inventors: Edwin K. Ruble, Parkton, MD (US); Demetrios Stavrakis, Booklandville, MD (US); Ted McKaughan, Forest Hill, MD (US)

(73) Assignee: ADCOR Industries, Inc., Baltimore, MD (US)

( * ) Notice: Subject to any disclaimer, the term of this patent is extended or adjusted under 35 U.S.C. 154(b) by 0 days.

(21) Appl. No.: 11/685,858

(22) Filed: Mar. 14, 2007

(65) Prior Publication Data

US 2007/0169835 A1 Jul. 26, 2007

Related U.S. Application Data

(62) Division of application No. 11/079,157, filed on Mar. 14, 2005, now abandoned.

(60) Provisional application No. 60/552,788, filed on Mar. 12, 2004, provisional application No. 60/552,772, filed on Mar. 12, 2004.

(51) Int. Cl.
*B65B 43/42* (2006.01)

(52) U.S. Cl. ..... 141/147; 141/57; 141/144; 141/146; 141/285; 141/302

(58) Field of Classification Search ..... 141/6, 141/39, 57, 144–147, 192, 198, 285, 301, 141/302

See application file for complete search history.

(56) References Cited

U.S. PATENT DOCUMENTS 2,796,892 A 6/1957 Meyer
3,090,408 A * 5/1963 Naecker ..... 141/57
3,209,794 A * 10/1965 Granier ..... 141/46
4,014,372 A 3/1977 Dichiara
4,206,789 A 6/1980 Jordan et al.
4,398,575 A 8/1983 Brandon
4,431,037 A 2/1984 Schevey et al.
4,442,873 A 4/1984 Yun
4,445,549 A 5/1984 Bernhard
4,750,533 A 6/1988 Yun
4,979,546 A 12/1990 LaWarre, Sr. et al.
5,085,255 A 2/1992 LaWarre, Sr. et al.
5,139,058 A 8/1992 Yun
5,273,084 A 12/1993 Monnig
5,425,402 A 6/1995 Pringle
5,634,500 A 6/1997 Clusserath et al.
5,884,677 A 3/1999 McKaughan
5,992,455 A 11/1999 Koller et al.
6,131,624 A 10/2000 Paradies (Continued)

*Primary Examiner*—Timothy L. Maust
(74) *Attorney, Agent, or Firm*—Howard & Howard Attorneys, P.C.

(57) ABSTRACT

A filling valve apparatus having a body portion with an inner wall terminating at an aperture to define a sealing seat. The inner wall extends below the seat to define a trap for a fluid. A cage extends from the body portion with the cage having an inner wall mating with the inner wall of the body portion to define a continuous inner surface. A stem, having a seal, includes an outer surface that is complementary in configuration to the continuous inner surface to define a smooth passageway for the fluid as the fluid is directed into the container thereby ensuring a laminar flow of the fluid between the inner and outer surfaces and into the container. The filling valve apparatus also includes a pre-assembled body portion, valve assembly, cap assembly, lower vent tube assembly, and snift valve.

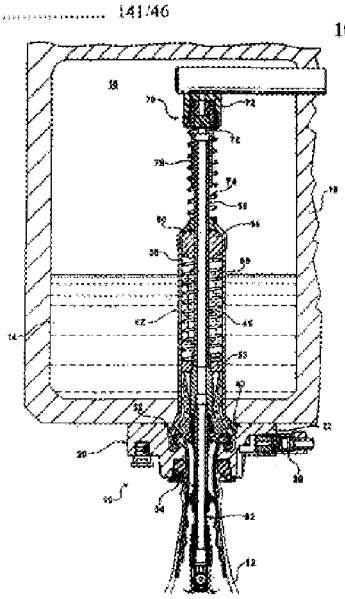

10 Claims, 6 Drawing Sheets